US006553735B1

(12) United States Patent
Wang Chen

(10) Patent No.: US 6,553,735 B1
(45) Date of Patent: Apr. 29, 2003

(54) JOINT STRUCTURE AS REINFORCING RIB TO INJECTED FRAME OF DOOR LEAF WITH GLASS

(75) Inventor: Kuei Yung Wang Chen, Taipei (TW)

(73) Assignee: Nan Ya Plastics Corporation, Taipei (TW)

( * ) Notice: Subject to any disclaimer, the term of this patent is extended or adjusted under 35 U.S.C. 154(b) by 0 days.

(21) Appl. No.: 09/985,815

(22) Filed: Nov. 6, 2001

(51) Int. Cl.[7] ..... E06B 3/58

(52) U.S. Cl. ..... 52/455; 52/208; 52/204.6; 52/457

(58) Field of Search ..... 52/204.59, 204.591, 52/204.6, 455, 456, 457, 585.1, 208

(56) References Cited

U.S. PATENT DOCUMENTS 3,903,669 A * 9/1975 Pease et al. ..... 411/339
3,965,638 A * 6/1976 Newman ..... 49/501
4,018,022 A * 4/1977 Fink ..... 49/DIG. 1
4,550,540 A 11/1985 Thorn
4,720,951 A 1/1988 Thorn et al.
4,850,168 A * 7/1989 Thorn ..... 49/501
4,864,789 A 9/1989 Thorn
4,947,597 A * 8/1990 Simpson ..... 52/204.591
5,018,330 A * 5/1991 Lewkowitz ..... 52/455
5,175,970 A * 1/1993 Green ..... 49/506
5,369,922 A * 12/1994 Hansen ..... 52/204.54
5,577,355 A * 11/1996 Leonelli ..... 52/204.591
5,644,870 A * 7/1997 Chen ..... 49/501
5,765,325 A * 6/1998 DeBlock ..... 52/171.1
5,887,398 A 3/1999 Chen
5,934,040 A * 8/1999 Chen ..... 52/309.11
6,318,037 B1 * 11/2001 Hansen ..... 52/204.54

* cited by examiner

*Primary Examiner*—Carl D. Friedman
*Assistant Examiner*—Brian E. Glessner
(74) *Attorney, Agent, or Firm*—Stevens, Davis, Miller & Mosher, LLP

(57) ABSTRACT

An improved assembly structure of a door leaf with glass, with a halving structure of two halving injected frames having the same structure with glass, includes, at the reverse side of the halving injected frames with glass having a male tenon reinforcing rib with a plurality of female tenons mutually in symmetrical arrangement. That is, both are disposed correspondingly with each other top-to-bottom and left-to-right. Therefore, two identical halving injected frames (having the same structure) are capably halved each other by correspondingly relative male tenons inserted into relative female respectively. The structure is without need of joint members to quickly assemble a door leaf with glass when the two identical halving injected frames are held on a door leaf to further fix a multiple-layer glass therein. This saves assembling time and decreases cost.

11 Claims, 3 Drawing Sheets

JOINT STRUCTURE AS REINFORCING RIB TO INJECTED FRAME OF DOOR LEAF WITH GLASS

BACKGROUND OF THE PRESENT INVENTION

1. Field of the Present Invention

The present invention relates to the improvement on the assembly structure of door leaf with glass; and more particularly relates to the halving structure of two identical halving injected frames with glass. At the reverse side of the halving injected frames with glass having a male tenon reinforcing rib with a plurality of male tenons and a female tenon reinforcing rib with a plurality of female tenons mutually in symmetrical arrangement, i.e., both disposed correspondingly each other top-to-bottom and left-to-right; therefore, two identical halving injected frames (having the same structure) are capably halved each other by correspondingly relative male tenons inserted into relative female respectively to fix a multiple-layer glass therein without the need of joint members such as screws.

2. Description of Prior Art

In the technical field of assembling door leaf with glass, screws are traditionally used as joint member of assembling glass; this is well known. However, by the improving of technique, the skill of composing the door leaf by using screws to joint and assemble glass will be obsolete gradually due to the following shortcomings:

(1) The injected frame for fixing the glass needs to use two molds simultaneously while molded, which causes a high cost.

(2) One side of the injected frame with glass has holes, the other side has no holes, which is troublesome while installing to identify indoor side or outdoor side.

(3) The holes of injected frame with glass need to be plugged in with a plug which not only is easy to fall off but also needs to use extra mold.

(4) It is required to use silicon in advance, joint with screws and then plug in the plug; procedures are complicated.

(5) Jointing procedure needs to be finished before packaging and delivering to prevent the silicon from damaging the coated surface.

In addition, said injected frame for fixing the glass traditionally uses a point reinforcing rib to solve the problem of lack of strength. This method remains to be improved despite of its capability, more or less, of strengthening the injected frame for fixing the glass; a reinforcing rib which integrally surrounds the injected frame with glass, for example, has much better reinforcing strength effect than that of point reinforcing rib.

SUMMARY OF THE PRESENT INVENTION

In view of disadvantages of the structure of the traditional door leaf with glass, which joints and assembles the glass by screws, the present invention researches and develops, depending on years of experience on manufacturing door leaf comprising its assembling structure and fittings, a new structure of fixing the injected frame with glass by halving in order to solve problems derived by traditional screw joint structure. Meanwhile, the reinforcing rib of the present invention includes a male tenon reinforcing rib provided with a plurality of male tenons thereon and a female tenon reinforcing rib provided with corresponding female tenon thereon too, and both the male tenon reinforcing rib and the female tenon reinforcing rib are integrally formed and symmetrically surrounded on the reverse side of the injected frame with glass to strengthen the halving injected frame with glass.

The primary purpose of the present invention is to make the reverse side of the halving injected frames with glass having a male tenon reinforcing rib with a plurality of male tenons and a female tenon reinforcing rib with a plurality of female tenons mutually in symmetrical arrangement, i.e., both disposed correspondingly each other top-to-bottom and left-to-right; therefore, two identical halving injected frames (having the same structure) are capably halved each other by correspondingly relative male tenons inserted into relative female respectively, it is without the need of joint members to quickly assemble a door leaf with glass when the two identical halving injected frames are held on a door leaf to further fix a multiple-layer glass therein. The present invention is to save assembling time and decrease cost.

The secondary purpose of the present invention is to make the structure of male tenons and female tenons of the halving injected frame have a duplex positioning effect. While the two halving injected frames (having the same structure) with glass joint each other to assemble and compose a door leaf with glass, each tenon rib of male tenons is tenoned into the tenon groove of a female tenon respectively to reach the first positioning effect; by a successive and further tenoning, the female tenon head of the female tenon is tenoned into the positioning groove of male tenon and the tenon nose of the male tenon is tenoned into the positioning groove of the female tenon so as to accomplish the second positioning and tenoning fix effect.

It is a further purpose of the present invention to use the structures of both the male tenon reinforcing rib and the female tenon reinforcing rib integrally formed and symmetrically surrounded on the reverse side of the injected frame with glass to strengthen structural strength of the halving injected frame of the present invention.

BRIEF DESCRIPTION OF THE DRAWING FIGURES

DETAILED DESCRIPTION OF THE PREFERRED EMBODIMENTS

Figure 1:
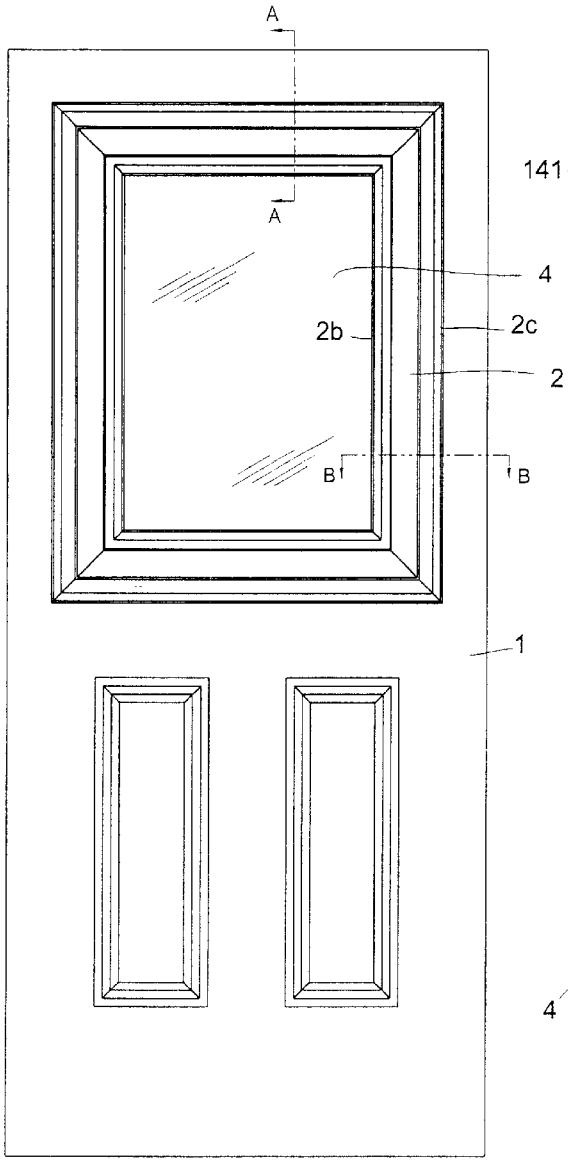
FIG. 1 is a front view of a door leaf with glass of the present invention.

The characteristics and functions of the present invention and its preferred embodiment are described as follows (accompanied by its drawings):

Referring to FIGS. 1–5, the door leaf with glass disclosed by the present invention at least comprises a main door leaf (1), two identical halving injected frames (2), (3) and a multiple-layers glass (4). The main door leaf (1) is rectangular shape and is provided with an opening (1*a*) shown as FIG. 5 for the two identical halving injected frames (2), (3) and the multiple-layers glass (4) fixedly assembled thereon. By using computer numerical control (CNC) machine for cutting operation, the opening (1*a*) of the main door leaf (1) is capably formed as various shapes including square, rectangular, circle, ellipse or semicircle etc. So that the shape of the two identical halving injected frames (2), (3) and the multiple-layer glass (4) to be assembled onto the opening (1*a*) of the main door leaf (1) are formed as similar relative shape correspondingly.

Further referring to FIGS. 6–9, both the halving injected frames (2) and the halving injected frames (3) are inject-molded or extrusion-molded from the same mold so that the halving injected frames (2) and the halving injected frames (3) are identical products with identical structure. Each halving injected frames (2), (3) of the present invention has an opening (2*a*), (3*a*) opened in its center, and a male tenon reinforcing rib (15) and female tenon reinforcing rib (14) mutually in symmetrical arrangement formed on its reverse side. Therefore, the halving injected frame (2), (3) has a hollow outline having an inner edge (2*b*), (3*b*) and an outer edge (2*c*), (3*c*). Both the male tenon reinforcing rib (15) and the female tenon reinforcing rib (14) are integrally formed and symmetrically surrounded on the reverse side of the injected frame with glass (2), (3) to strengthen its structural strength. The practical embodiment of the halving injected frames (2), (3) of the present invention is shown as FIGS. 6–11, which male tenon reinforcing rib (15) and the female tenon reinforcing rib (14) mutually in symmetrical arrangement disposed correspondingly top-to-bottom and left-to-right to make both the halving injected frames (2), (3) combine each other by correspondingly relative male tenon reinforcing rib (15) inserted into the relative female tenon reinforcing rib (14) respectively.

In addition, the material of the halving injected frame (2) or (3) is selected from wood powder, aluminum, polystyrene, polyvinyl chloride, mixture of polyvinyl chloride and wood powder, polypropylene, or mixture of polypropylene and glass fiber; meanwhile, the surface of the halving injected frame (2) or (3) is capably manufactured to a smooth surface or a vein-like surface.

Figure 10:
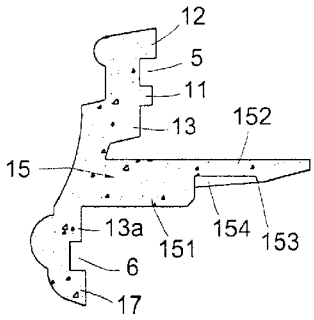
FIG. 10 is an enlarged sectional view of the male tenon reinforcing rib (15) of the two identical halving injected frames (2), (3).
Figure 11:
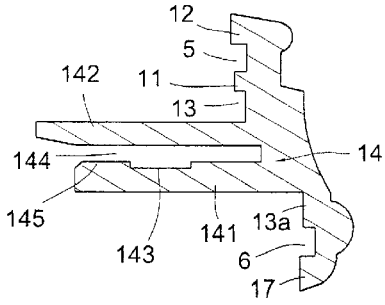
FIG. 11 is an enlarged sectional view of the female tenon reinforcing rib (14) of the two identical halving injected frames (2), (3).

Referring to FIGS. 6–11, at the reverse side of the halving injected frame (2), (3), an inner rib part (12) having a smooth surface is bulged along the overall outline of the inner edge (2*b*), (3*b*), and an intermediate rib part (11) having a smooth surface is bulged as well which overall outline is a little bit distant from and parallel to the inner rib part (12). However, the height of the bulged intermediate rib part (11) is lower than that of the inner rib part (12); wherein the difference between these two heights is about 0.5 mm. Consequently, the area located between the inner rib part (12) and the intermediate rib part (11) forms a groove (5) which surrounds the overall outline of halving injected frame (2) or (3). In additional, a flat surface (13) is formed next to the other side of the intermediate rib part (11) and surrounds the overall outline of the halving injected frame (2), (3). An outer rib part (17) having a smooth surface is bulged along the overall outline of the outer edge (2*c*), (3*c*) of the halving injected frame (2), (3), which location is relative to that of inner rib part (12) in inclined direction, and a groove (6) and a flat surface (13*a*) shown as FIGS. 10–11 is formed next to the outer rib part (17) and surrounds the overall outline of the halving injected frame (2), (3).

In the middle of the flat surface (13) and the flat surface (13*a*), a tenon reinforcing rib (15) and a female tenon reinforcing rib (14) mutually in symmetrical arrangement are correspondingly formed. Both the tenon reinforcing rib (15) and the female tenon reinforcing rib (14) are designed as an integrally surrounding ribs which are symmetrically formed as a half surroundings relative to the overall outline of the halving injected frame (2), (3) respectively. By use of both the tenon reinforcing rib (15) and the female tenon reinforcing rib (14) are designed as integrally surrounding ribs to reinforce the structural strength of the halving injected frame (2), (3) and to accomplish an effect of positioning the multiple-layer glass (4) therein.

The detailed structures of the tenon reinforcing rib (15) and the female tenon reinforcing rib (14) are respectively shown as FIG. 10 and FIG. 11, the male reinforcing rib tenon (15) comprises a footing rib (151) and a tenon rib (152). The footing of the footing rib (151) is connected to the reverse side of the halving injected frame (2), (3), and the tenon rib (152) superposed on the top of the footing rib (151) is provided with a positioning groove (154) and a a tenon nose (153), wherein the positioning groove (154) is to supply a room to accommodate a female tenon head (145) of the female tenon reinforcing rib (15) therein. Additionally, the front end of the tenon rib (152) formed an inclined surface is to supply a convenient way for the tenon rib (152) to halve or disassemble with the female tenon reinforcing rib (14).

Figure 3:
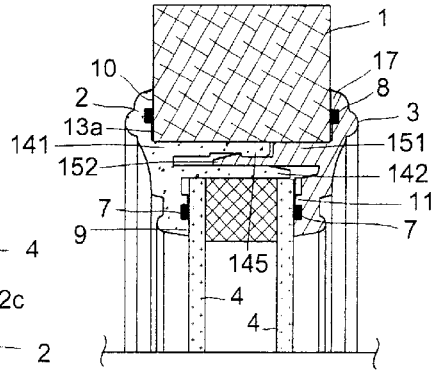
FIG. 3 and FIG. 4 are enlarged fragmentary sectional view looking as indicated by the lines A—A and B—B of FIG. 1.
Figure 2:
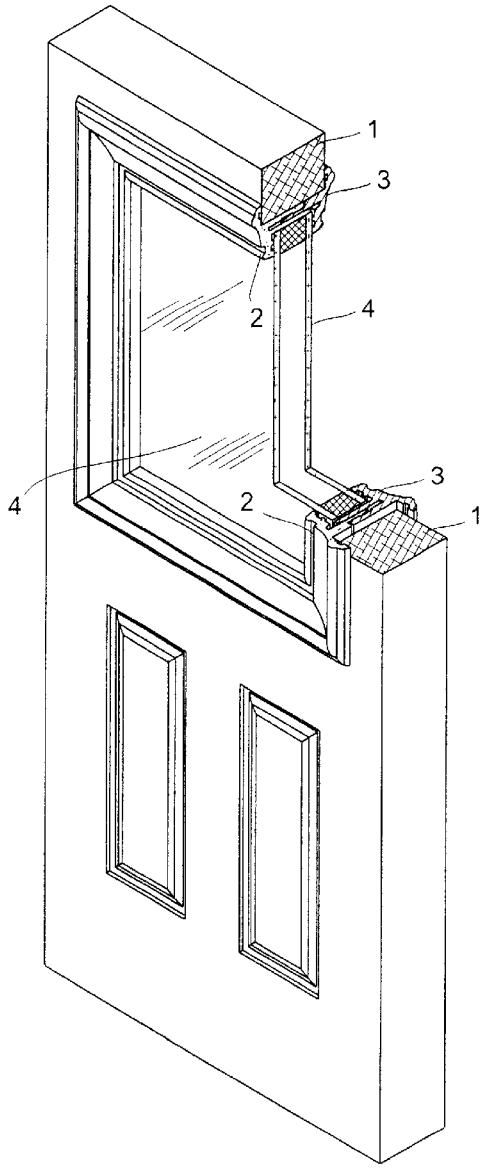
FIG. 2 is a partial sectioned perspective view of a door leaf with glass of the present invention.
Figure 4:
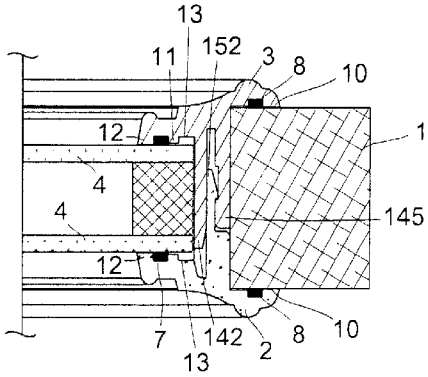
Figure 5:
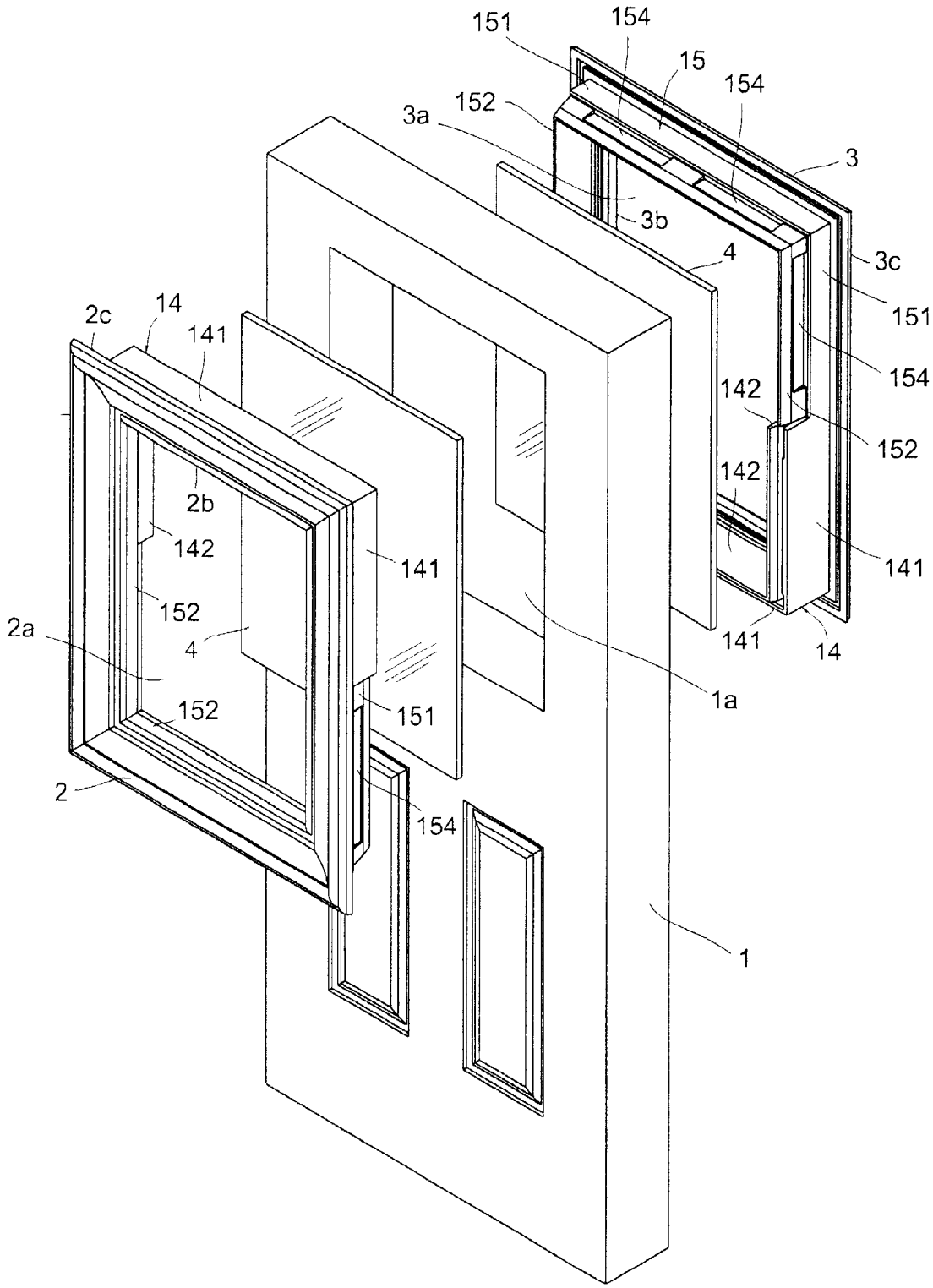
FIG. 5 is an exploded structure drawing of a door leaf with glass of the present invention, where two identical halving injected frames (2), (3) are shown.
Figure 6:
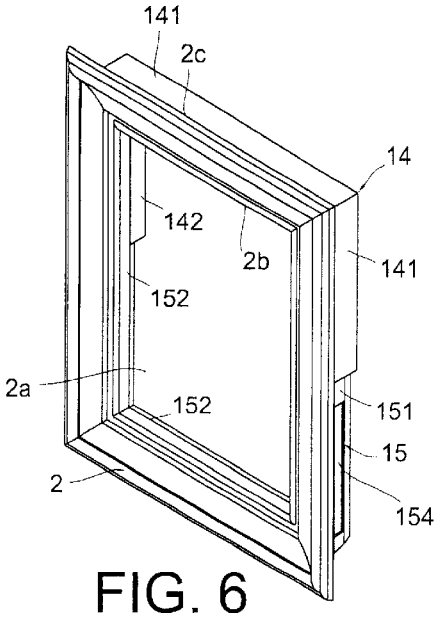
FIG. 6 is a perspective view of the halving injected frames (2) of the present invention having a male tenon reinforcing rib (15) and a female tenon reinforcing rib (14) mutually in symmetrical arrangement.
Figure 8:
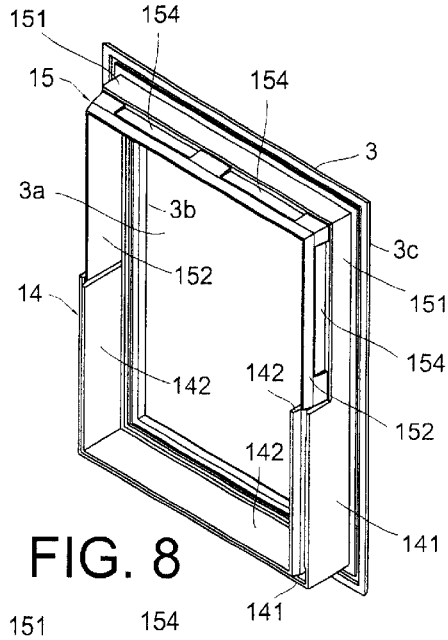
FIG. 8 is a perspective view of the halving injected frames (3) of the present invention having a male tenon reinforcing rib (15) and a female tenon reinforcing rib (14) mutually in symmetrical arrangement.
Figure 7:
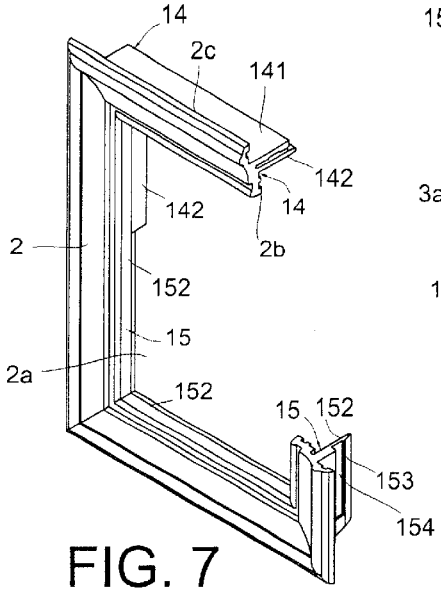
FIG. 7 is a partial sectioned perspective view of the halving injected frames (2) of the present invention to show the structure of male tenon reinforcing rib (15) and female tenon reinforcing rib (14).
Figure 9:
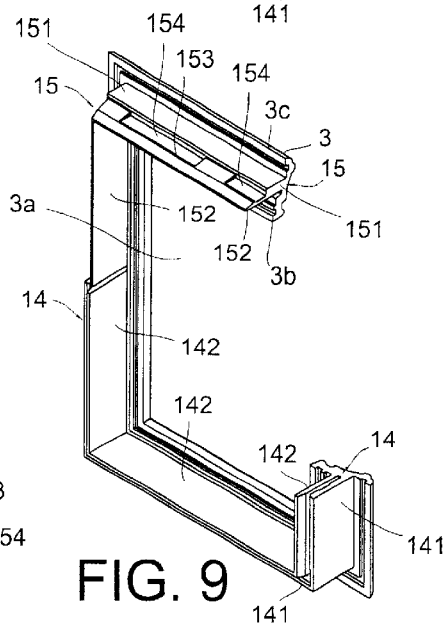
FIG. 9 is a partial sectioned perspective view of the halving injected frames (3) of the present invention to show the structure of male tenon reinforcing rib (15) and female tenon reinforcing rib (14).

The female tenon reinforcing rib (14) comprises a fixing rib (141) and a leading rib (142). The footings of the fixing rib (141) and the leading rib (142) all connect to the reverse side of the halving injected frame (2), (3). The fixing rib (141) and the leading rib (142) are disposed in a distance which forms a tenon groove (144) of the female tenon reinforcing rib (14) to supply a room to accommodate the tenon rib (152) of the male tenon reinforcing rib (15). Due to the length of the leading rib (142) designed as longer than that of the fixing rib (141), the front end of the leading rib (142), which is directed to the tenon groove (144) side, capably forms an inclined surface to make the tenon rib (152) of the male tenon reinforcing rib (15) be conveniently led into the tenon groove (144) of the female tenon reinforcing rib (14). The fixing rib (141) is provided with a positioning groove (143) notched on the proper area of the surface directed to the tenon groove (144), therefore, a female tenon head (145) next to the positioning groove (143) is relatively formed at the front end of the fixing rib (141). The width of the female tenon head (145) is corresponding to the width of the positioning groove (154) of the male tenon reinforcing rib (15). As shown in FIGS. 2–4, while the relative male tenon reinforcing rib (15) and the relative female tenon reinforcing rib (14) of the halving injected frame (2), (3) are mutually halved each other, the tenon rib (152) of the relative male tenon reinforcing rib (15) is inserted into the tenon groove (144) of the relative female tenon reinforcing rib (14) to simultaneously make the female tenon head (145) of the relative female tenon reinforcing rib (14) inserted into the positioning groove (154) of the relative male tenon reinforcing rib (15), and make the tenon nose (153) of the relative male tenon reinforcing rib (15) inserted into the positioning groove (143) of the relative female tenon reinforcing rib (14).

Therefore, by attaching the reverse side of the halving injected frame (3) to the reverse side of the halving injected frame (2), the tenon rib (152) of the male tenon reinforcing rib (15) of each frame is tenoned each other into the corresponding tenon groove (144) of the female tenon reinforcing rib (14) to accomplish the primary positioning effect; then continuously attach them closer so as to make the female tenon head (145) of the female tenon reinforcing rib (14) be tenoned into the positioning groove (154) of the male tenon reinforcing rib (15) and make the tenon nose (153) of the male tenon reinforcing rib (15) be inserted into the positioning groove (143) of the female tenon reinforcing rib (14) to accomplish the secondary positioning effect. Through said duplex positioning effect, the halving injected frame (2) and the halving injected frame (3) are held on each other, and are assembled with the main door leaf (1) and the multiple-layer glass (4) as a whole to compose a door leaf with glass.

Referring to FIGS. 1–4, the assembling procedures of the door leaf with glass disclosed by the present invention are described as follows:

(a) Selecting one of the two identical halving injected frames (2), (3) (for the sake of convenient description, the halving injected frame (2) is selected as an example), then fill silicon (7) in the groove (5) of the halving injected frame (2) for obtaining good sealing effect while installed with the multiple-layer glass (4); similarly, fill silicon (8) in the groove (6) of the halving injected frame (2);

(b) Attaching the halving injected frame (2) to the opening (1*a*) of the main door leaf (1), the main door leaf (1) is adhesion-combined by using the silicon (8) which is filled in the groove (6) of the halving injected frame (2) to make the halving injected frame (2) closely adhere to the surface of the main door leaf (1) with water-proof effect, in addition, on the surface of the outer rib part (17) of the halving injected frame (2) can be secondary-injected to form a soft pad (10) to obtain better sealing effect while adhesion-combined to the main door leaf (1);

(c) Next, attaching at least a piece of multiple-layer glass (4), with the shape similar to that of the opening (1*a*) of the main door leaf (1) but the size a little smaller, to the halving injected frame (2) so that the weight of the multiple-layer glass (4) is supported by the female tenon reinforcing rib (14) of the halving injected frame (2), and the silicon (7) is filled in the groove (5) of the halving injected frame (2) adhesion-combine with the glass (4). Since the height of the bulged surface of the intermediate rib part (11) of the halving injected frame (2) is about 0.5 mm lower than that of the bulged surface of the inner rib part (12), there is a little bit of seam to be kept between said intermediate rib part (11) and the glass (4); therefore, when the glass (4) and the halving injected frame (2) are pressed closely for adhesive combination, part of the silicon (7) filled in the groove (5) , due to being pressed, will flow out and through the seam between the intermediate rib part (11) and the glass (4) into the space of the flat surface (13) of the halving injected frame (2) to make the glass (4) be closely adhesion-combined with the halving injected frame (2). While a reinforced water-proof effect is required, , on the surface of the inner rib part (12) of the halving injected frame (2) can be secondary-injected to form a soft pad (9) to obtain better sealing effect while adhesion-combined to the glass (4);

(d) Moreover, the other halving injected frame (3) is assembled with the same manner as that of said halving injected frame (2) and main door leaf (1) and glass (4); first, fill silicon (7) in the groove (5) and fill silicon (8) in the groove (6) of the halving injected frame (3). In order to obtain a reinforced water-proof effect, on the surface of the inner rib part (12) and outer rib part (17) of the halving injected frame (3) can be secondary-injected to form soft pads (9) and (10); thereafter, attach the halving injected frame (3) to the other side of the opening (1*a*) of the main door leaf (1) and attach the reverse side of the halving injected frame (3) to the reverse side of the halving injected frame (2) in such way that the tenon rib (152) of the male tenon reinforcing rib (15) of each frame is tenoned each other into the corresponding tenon groove (144), then continuously attach them closer to make the female tenon head (145) of the female tenon reinforcing rib (14) be tenoned into the positioning groove (154) of the male tenon reinforcing rib (15) and make the tenon nose (153) of the male tenon reinforcing rib (15) be tenoned into the positioning groove (143) of the female tenon reinforcing rib (14) to make both frames be held each other on the main door leaf (1) and to make the multiple-layer glass (4) be supported and positioned by the female tenon reinforcing rib (14) of the halving injected frame (2), (3). A door leaf assembly with glass disclosed by the present invention is then quickly completed.

As described above, the structure of the joint structure as reinforcing rib to halving injected frame of door leaf with glass is of novelty, usefulness, and improvement to prior art.

What is claimed is:

1. A joint structure for a reinforcing rib of an injected frame of a door leaf, comprising:

a main door leaf with a rectangular shape;

two complementary halving injected frames; and a glass pane having multiple layers of glass, wherein the main door leaf has an opening for said two complementary halving injected frames and the glass pane fixedly assembled thereon;

said two complementary halving injected frames each have a hollow frame structure including an inner edge and an outer edge, said two complementary halving injected frames have on their respective reverse sides, a male tenon reinforcing rib and a female tenon reinforcing rib formed in mutual arrangement with a corresponding female tenon reinforcing rib and a male tenon reinforcing rib, respectively, of the complementary one of said two halving injected frames, each male tenon reinforcing rib has a footing rib connected to the reverse side of the corresponding halving injected frame and a tenon rib superposed on a top of the footing rib, which tenon rib is provided with a positioning groove and a tenon nose, and each female tenon reinforcing rib comprises a fixing rib and a leading rib both connected to the reverse side of the corresponding halving injected frame, the fixing rib and the leading rib being disposed at a distance to form a tenon groove that supplies room for the tenon rib of the male tenon reinforcing rib, from the complementary halving injected frame, to be inserted therein, and the fixing rib is provided with a positioning groove notched on a surface directed toward the tenon groove and a female tenon head next to the positioning groove.

2. The joint structure of claim 1, wherein:

each male tenon reinforcing rib is mutually tenoned to the corresponding female tenon reinforcing rib of the complementary halving injected frame by way of:

(a) inserting the tenon rib of the relative male tenon reinforcing rib into the tenon groove of the corresponding female tenon reinforcing rib;

(b) inserting the female tenon head of the female tenon reinforcing rib into the positioning groove of the corresponding male tenon reinforcing rib; and (c) inserting the tenon nose of the male tenon reinforcing rib into the positioning groove of the corresponding female tenon reinforcing rib.

3. The joint structure as reinforcing rib to, halving injected frame of door leaf with glass as defined by claim 1, wherein the tenon nose is formed in the front end of said tenon rib to make the front end of said tenon rib form an inclined surface to supply a convenient way for said tenon rib to halve or disassemble with said female tenon by using said inclined surface at the front end.

4. The joint structure as reinforcing rib to halving injected frame of door leaf with glass as defined by claim 2, wherein the tenon nose is formed in the front end of said tenon rib to make the front end of said tenon rib form an inclined surface to supply a convenient way for said tenon rib to halve or disassemble with said female tenon by using said inclined surface at the front end.

5. The joint structure as reinforcing rib to halving injected frame of door leaf with glass as defined by claim 1, wherein the length of said leading rib is longer than that of said fixing rib, and the front end of said leading rib forms an inclined surface to have the outlet of said tenon groove of said female tenon form an enlarged shape to make said tenon rib of said male tenon be conveniently led into said tenon groove of said female tenon.

6. The joint structure as reinforcing rib to halving injected frame of door leaf with glass as defined by claim 1, wherein the shape of said opening of said main door leaf for installing glass is square, rectangular, circle, ellipse, or semicircle.

7. The joint structure as reinforcing rib to halving injected frame of door leaf with glass as defined by claim 2, wherein the shape of said opening of said main door leaf for installing glass is square, rectangular, circle, ellipse, or semicircle.

8. The joint structure as reinforcing rib to halving injected frame of door leaf with glass as defined by claim 1, wherein the material of the halving injected frame with glass is selected from one of the following materials: wood powder, aluminum, polystyrene, polyvinyl chloride, mixture of polyvinyl chloride and wood powder, polypropylene, or mixture of polypropylene and glass fiber.

9. The joint structure as reinforcing rib to halving injected frame of door leaf with glass as defined by claim 2, wherein the material of the halving injected frame with glass is selected from one of the following materials: wood powder, aluminum, polystyrene, polyvinyl chloride, mixture of polyvinyl chloride and wood powder, polypropylene, or mixture of polypropylene and glass fiber.

10. The joint structure as reinforcing rib to halving injected frame of door leaf with glass as defined by claim 1, wherein the surface of the halving injected frame with glass is a smooth surface or a vein-like surface.

11. The joint structure as reinforcing rib to halving injected frame of door leaf with glass as defined by claim 2, wherein the surface of the halving injected frame with glass is a smooth surface or a vein-like surface.

* * * * *